United States Patent [19]

Stewart

[11] 4,033,136

[45] July 5, 1977

[54] VAPOR ACTUATED POWER GENERATING DEVICE

[76] Inventor: Robert C. Stewart, Rte. 5, Box 374, Spokane, Wash. 99200

[22] Filed: Nov. 20, 1975

[21] Appl. No.: 633,679

[52] U.S. Cl. ..... 60/671; 91/417 R; 91/481; 91/491

[51] Int. Cl.[2] ..... F01K 25/00

[58] Field of Search ..... 91/188, 495, 491, 481, 91/417, 235; 92/69; 60/671, 651

[56] References Cited

UNITED STATES PATENTS

| | | | |
|---|---|---|---|
| 573,216 | 12/1896 | Halvorsen | 91/417 X |
| 679,016 | 7/1901 | Duchamp et al. | 91/481 |
| 2,088,582 | 8/1937 | Bishop | 91/481 X |
| 2,115,556 | 4/1938 | Maniscalco | 91/188 X |
| 2,746,430 | 5/1956 | Steen | 91/235 X |
| 3,521,535 | 7/1970 | Oelrich | 91/417 X |
| 3,531,933 | 10/1970 | Baldwin | 60/671 X |

*Primary Examiner*—Irwin C. Cohen
*Attorney, Agent, or Firm*—William C. Babcock

[57] ABSTRACT

A power generating device that transforms the energy of vapor under pressure from a volatile liquid into useful rotational power that may be used in a stationary location or to propel a vehicle. The vapor under pressure is generated either by heating the volatile liquid in a confined space by means of fuel, or by utilizing solar energy for this purpose.

After the vapor has passed through the power generating device it is cooled and returned to the liquid state. The volatile liquid is, by means of a pump, returned to the confined space where it is again heated to transform to vapor under pressure, with the vapor then being recycled through the power generating device.

7 Claims, 7 Drawing Figures

VAPOR ACTUATED POWER GENERATING DEVICE

BACKGROUND OF THE INVENTION

1. Field of the Invention

Vapor actuated power generating device.

2. Description of the Prior Art

In the past, the desirability of sequentially vaporizing a volatile liquid and thereafter condensing the vapor to the liquid state after it has performed useful work, has been realized, but no simple, efficient, power generating device has been available to transform the energy of the vapor into useful rotational power.

A major object of the present invention is to provide a vapor actuated power generating device that has a simple mechanical structure, and one that efficiently transforms the energy of pressurized vapor from a low boiling point liquid into rotational energy as the liquid forming the vapor is alternatively heated and condensed to be recycled through the invention.

SUMMARY OF THE INVENTION

The present rotational power generating device receives pressurized vapor from heating a low boiling point liquid, such as Freon or the like, in a confined space. Energy in the pressurized vapor is extracted therefrom as rotational power as the vapor flows through the present invention. After discharging from the rotational power generating device, the vapor is subjected to cooling to return the vapor into the liquid state. The condensed liquid is then by means of a power-driven pump, returned to the confined space to again be heated and pass through the above described power generating cycle.

In detail, the power generating device includes a housing assembly that has first and second end walls that are connected by a continuous side wall. The first end wall has a first conduit extending therefrom to receive pressurized vapor. The side wall has a second conduit extending therefrom through which vapor is discharged after flowing through the device, when the conduit delivering the vapor to a location where it is subjected to cooling to return to the liquid state. The housing assembly includes a transverse partition in the interior thereof that subdivides the interior into first and second compartments which are in communication with the first and second conduits.

The invention includes a cylinder-defining assembly disposed within the housing, and this assembly also includes a first inner cylindrical shell having a number of circumferentially spaced first openings formed therein. The first shell is surrounded by a second cylindrical shell having a number of circumferentially spaced second openings formed therein that are in radial alignment with the first openings. The first and second shells have first and second circumferential edges. A number of first tubular cylinders extend radially between the first and second openings in the first and second shells. A number of second tubular cylinders are supplied that extend inwardly from the second shell and are parallel and disposed adjacent to the first cylinders. First and second circular plates extend between the first and second circumferential edges of the first and second shells.

The first plate is adjacent to the partition secured thereto. A number of circumferentially spaced sets of first ports are provided that extend through the partition and second cylinders to establish communication between the first compartment and the interior of the second cylinders. A number of circumferentially spaced second ports are provided that establish communication between the interior of the second and first cylinders, and are axially aligned with the first sets of ports.

A first bearing is disposed in the housing, and is in coaxial alignment with the first shell, with the first bearing being supported from the cylinder-defining assembly. The power output shaft is journaled in the first bearing and extends outwardly through an opening formed in the second end wall. The power output shaft has a head secured to an end thereof that is disposed within the first shell.

A pin is eccentrically mounted on a shaft-supported head, with the pin extending towards the partition. A number of connecting rods having first and second end portions are provided, with the first end portions being pivotally connected to the above identified pin. A number of first pistons are slidably mounted in the first cylinders, with the second end portions of the piston rods being pivotally connected to the first pistons.

A first cam is supported from the free end of the pin, and occupies a fixed position relative to the head. A number of second pistons are slidably mounted in the second cylinder. A number of first springs are furnished that at all times tend to maintain the second pistons in contact with the first cam. A second cam is secured to the shaft and disposed within the housing.

Circumferentially spaced first members are slidably supported on the second shell, and when in first positions close the second openings in the second shell, with the first members including projecting projecting portions in which openings are defined. A number of second springs are provided that at all times tend to maintain the first members in first positions in which the outer ends of the first cylinders are closed. Second members are circumferentially spaced and slidably supported for radial movement from the second plate, with each of the second members including a first end that is in slidable abutting contact with the second cam, and a second angularly disposed end that engages one of the openings in one of the projecting portions of one of the members. A number of third springs are provided that serve to maintain the second members in contact with the second cam.

The power output shaft is driven by the vapor under pressure as it flows from the first compartment through an opening in the partition to the interior of the first cylindrical shell and inwardly disposed end portions of the first cylinders. The first cam cooperates with ech of the second pistons and the first springs to sequentially open the first sets of ports and second port associated therewith and allow vapor from the first compartment to flow into one of the first cylinders until the first piston therein has traversed to substantially the innermost position. During this travel the pressure on both ends of each first piston is the same. When the first piston is in this innermost position, the first cam has rotated to a position where the second piston associated with that particular first piston is moved to a position to obstruct communication between the first compartment and that particular first cylinder.

The second cam is rotating and is so related to the motion of the first cam that it moves one of the first members outwardly to permit the first member to move the second member associated with that particular cylinder towards the second end wall to allow vapor in the outer end of that particular first cylinder to escape therefrom into the second compartment and second conduit. Each of the first pistons in the invention are sequentially subjected to the above described operation, whereby the power output shaft is rotated to generate useful rotational power from the energy extracted from the pressurized vapor as it flows through the invention.

DESCRIPTION OF THE PREFERRED EMBODIMENT

Figure 1:
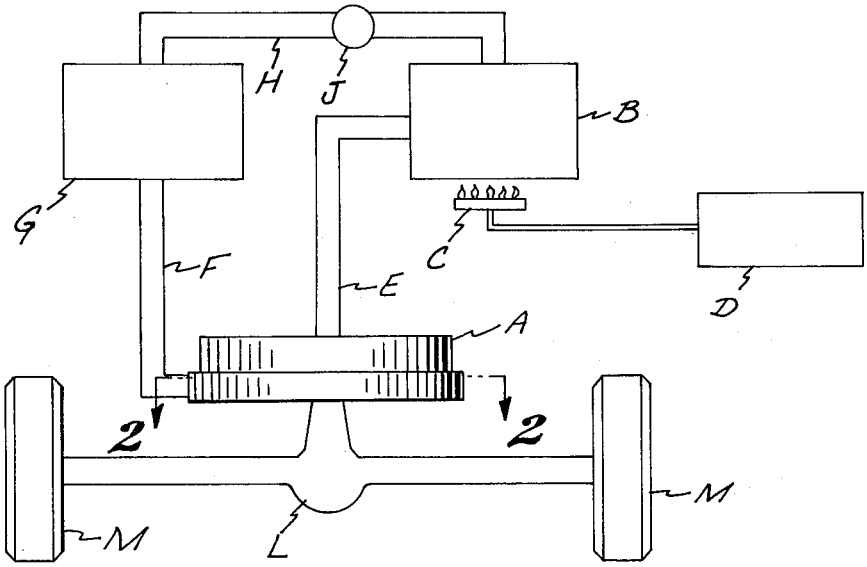
FIG. 1 is a diagrammatic view of the invention and illustrating the manner in which it is associated with a source of pressurized vapor from a volatile liquid, together with a device for cooling the vapor after the latter has passed through the invention to return the latter to the liquid state, and a pump for transferring the condensed liquid to a confined space to again be heated to be transformed to vapor that is recycled through the invention.

The vapor actuated power generating device A of the present invention, as may be seen in FIG. 1, is adapted to be used as a prime mover on a vehicle, as well as a prime mover when it occupies a stationary position. The power generating device A is used in conjunction with a first device B that heats a low boiling point liquid such as Freon to a pressurized vapor state. The first device B may be either a boiler as illustrated in the drawing that is heated by a burner C to which fuel is supplied from a source D, or a series of closed tubes (not shown) that are exposed to the sunlight to absorb heat and transform the low boiling point liquid to the pressurized vapor state. Irrespective of the source of heat for the device B, the latter has a first conduit E extending therefrom through which pressurized vapor flows to the power generating device A.

A second conduit F is provided through which the vapor is discharged after flowing through the power generating device A to return to a vapor condensing the device G, which device returns the vapor to the liquid state. After being condensed, the liquid flows through a third conduit H to a pump J that is power-driven, which pump through a fourth conduit H-1, delivers the liquid to the first device B to be recycled through the power generating device A.

Figure 3:
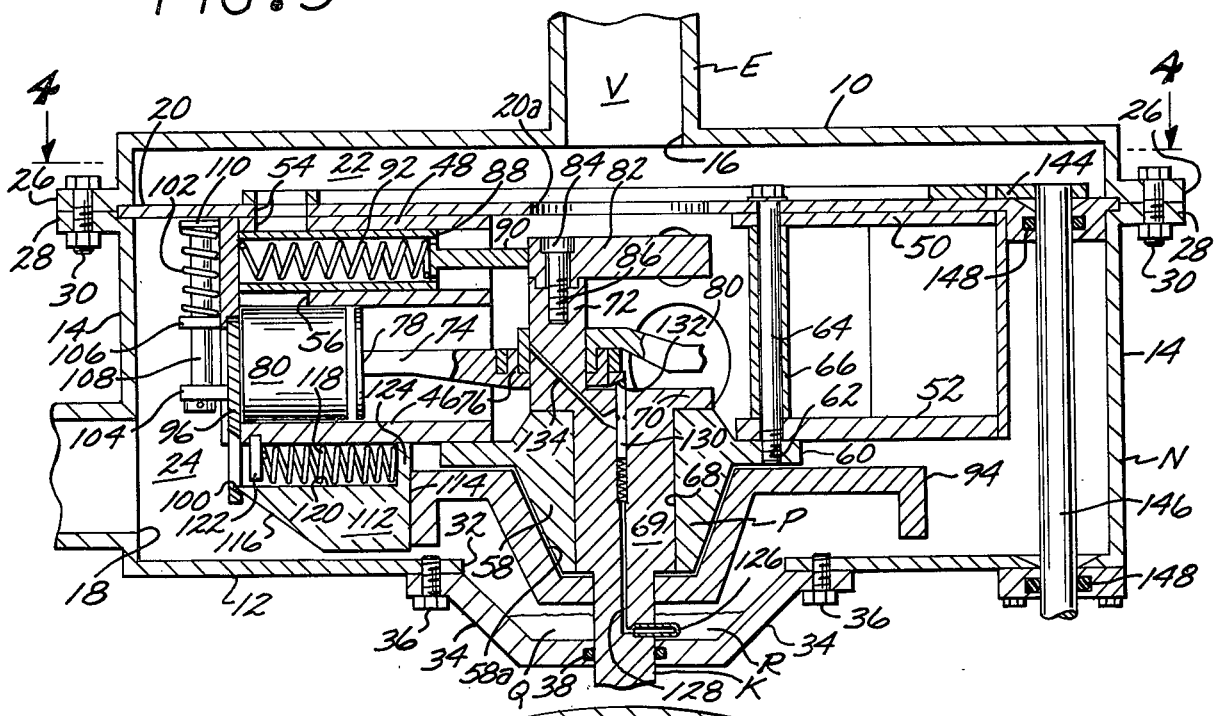
FIG. 3 is a cross-sectional view of the power generating device, taken on the line 3—3 of FIG. 2.

The vapor actuated power generating device A, as may be seen in FIG. 3, includes a power output shaft K. The output shaft K in the diagram as shown in FIG. 1, extends to a transmission L, which by conventional mechanical means transfers the rotational power of the shaft to two laterally spaced wheels M.

The structure of the vapor actuated power generating device A, as best seen in detail in FIG. 3, the power generating device A includes a housing assembly N. Assembly N includes a first end wall 10, second end wall 12, and a continuous side wall 14 that extends therebetween. The first conduit E is in communication with an opening 16 formed in the first end wall 10. The second conduit F is in communication with an opening 18 formed in the side wall 14.

The housing assembly N has an internal transverse partition 20, with the partition subdividing the interior of the housing N into a first compartment 22 and second compartment 24. The housing N, as illustrated in FIG. 3, is of two-part structure, with the first end wall 10 and portion of side wall 14 developing into a first flange 26, which is in abutting sealing contact with a second flange 28 that forms a part of the second portion of the housing that includes the second end wall 12 and a part of the side wall 14. Bolts 30 are furnished that extend through aligned openings in the first and second flanges to removably secure the two portions of the housing together in the configuration shown in FIG. 3.

The second end wall 12 has a centered opening 32 therein that is removably closed by a wall section 34 that is secured to the end wall by a number of spaced bolts 36. The wall section 34 has a sealed bearing 38 mounted therein in which the power output shaft K is rotatably disposed.

Figure 2:
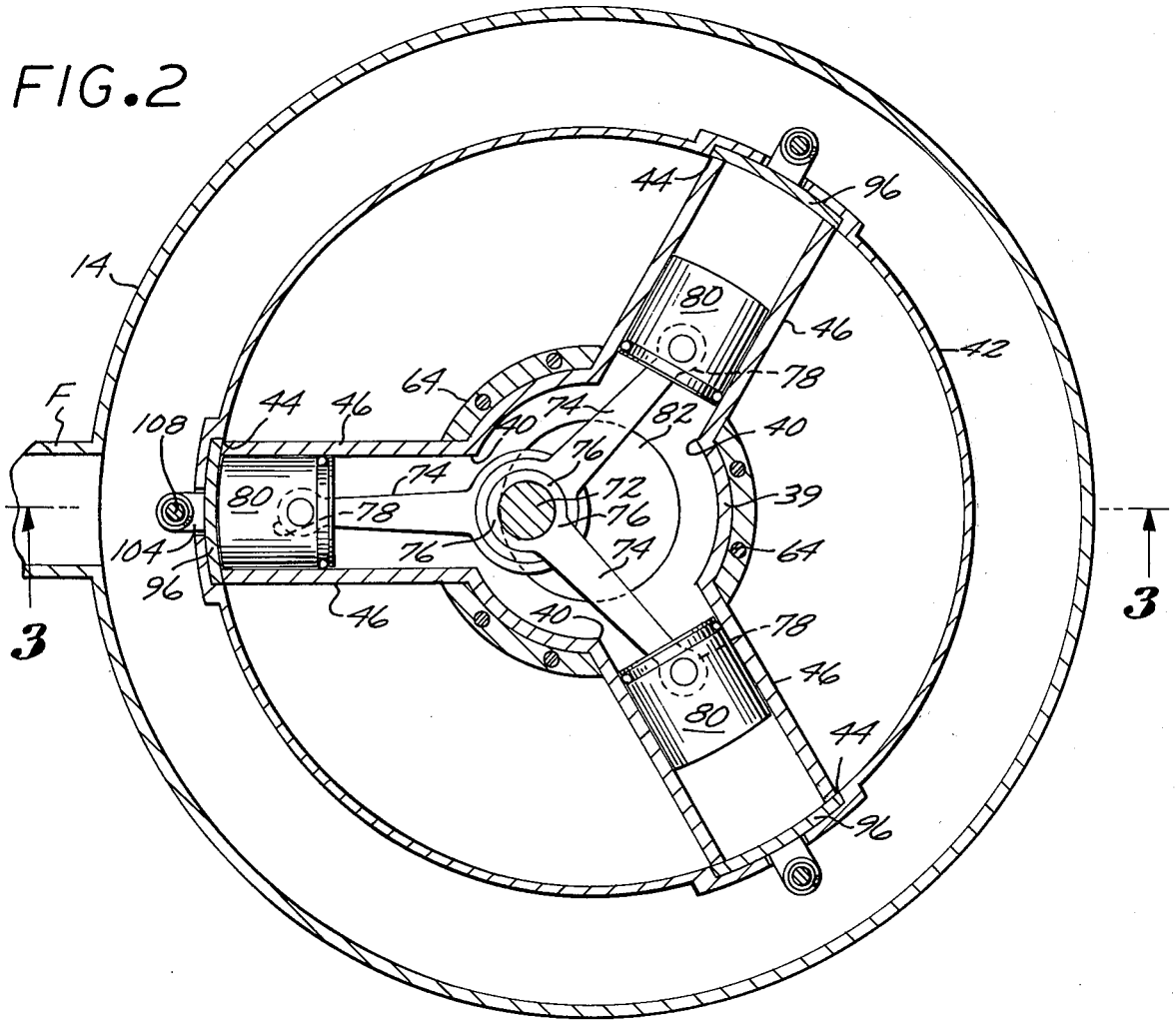
FIG. 2 is a transverse cross-sectional view of the power generating device.

The cylinder-defining assembly O, as best seen in FIG. 2, includes a first cylindrical shell 39 that has a number of circumferentially spaced first openings 40 defined therein. The first cylindrical shell 39 is concentrically disposed relative to a second cylindrical shell 42 that has a number of circumferentially spaced second openings 44 formed therein that are radially aligned with the first openings 40. A number of first tubular cylinders 46 are provided, with the first cylinders extending between the first openings 40 and the second openings 44 as shown in FIG. 2. In FIG. 3 it will be seen that each of the first cylinders 46 has a second cylinder 48 adjacently disposed thereto in parallel relationship, with the second cylinders being secured to a first circular plate 50. The cylinder-defining assembly O includes a second plate 52 as may be seen in FIG. 3. A number of circumferentially spaced sets of first ports 54 formed in the partition 20 and first plates 50 that are in communication with the first compartment 20. Each of the first cylinders 46 has a second port 56 therein that is axially aligned with one of the sets of first port 54 as best seen in FIG. 3.

The power generating device A, as may be seen in FIG. 3, includes a bearing P that is defined by a body 58 that has a circumferential flange 60 extending outwardly therefrom with the flange having a number of circumferentially spaced tapped bores 62 formed therein. A number of bolts 64 extend downwardly from the partition 20, which bolts are surrounded by tubular spacers 66, and the bolts engaging the tapped bores 62 to support the bearing P in a fixed position within the power generating device A as shown in FIG. 3. The bearing P has a downwardly and inwardly tapered external surface 58*a*. The bearing P has a bore 68 extending therethrough.

The power output shaft K as shown in FIG. 3 includes a portion 69 of enlarged transverse cross-section that is rotatably supported in the bore 68. Shaft portion 69 has a head 70 extending outwardly from the upper portion thereof, which head supports an upwardly extending pin 72 that is rotatably engaged by a number of interlocking connecting rods 74 that have first end portions 76 and second end portions 78. The second end portions 78 are, by conventional means (not shown), pivotally connected to the first pistons 82. The upper end of the pin 72, as viewed in FIG. 3, supports a first cam 82 that is secured thereto by a bolt 84 that extends downwardly through the cam to engage a tapped bore 86 formed in the pin. Second pistons 88 are mounted in the first cylinders 48 and have piston rods 90 extending inwardly therefrom. First compressed springs 82 of helical configuration are disposed in the second cylinders 48 and at all times urge the piston rods 90 into sliding pressure contact with the first cam 82.

In FIG. 3 it will be seen that the shaft K supports a second cam 94 that project outwardly therefrom.

A number of first plate-like members 96 are disposed in circumferential spacing on the second cylindrical shell 42 and when disposed in first positions, as shown in FIG. 3, have portions 98 that project downwardly therefrom in which openings 100 are formed. The first members 96 have first lugs 104 projecting outwardly therefrom that are axially aligned with second lugs 106 secured to the second cylindrical shell 42. Bolts 108 extend upwardly through openings in the first and second lugs 104 and 106, with the upper portions of the bolts having second helical springs extending therearound, and the springs being in abutting contact with nuts 110 or other abuttment means secured to the upper ends of the bolts.

A number of circumferentially spaced radially extending second members are slidably supported from the second plate 52 by conventional means (not shown) and the second members including first ends 114 and second ends 116 that taper upwardly at an angle. The second ends 116 are at all times in engagement with the openings 100. Third springs 118 of helical configuration are disposed in longitudinally extending recesses 120 formed in the upper portions of the second members 112, as viewed in FIG. 3, and the springs 118 having outwardly disposed ends thereof in abutting contact with lugs that extend downwardly from the second plate 52. The opposite ends of the third springs 118 are in contact with an abutment 124 that forms a part of the second members 112.

The upper surface of the sections 34 provides a sump Q for a quantity of oil R which oil is withdrawn from the sump Q through a strainer 126 into a passage 128 in shaft K by a spring-loaded reciprocating pump 130 that is actuated due to being in slidable contact with a cam 132 formed on one of the first piston rod portions 76. Oil is discharged from the pump 130 through a passage 134 to lubricate the first piston rod portions 76.

Figure 4:
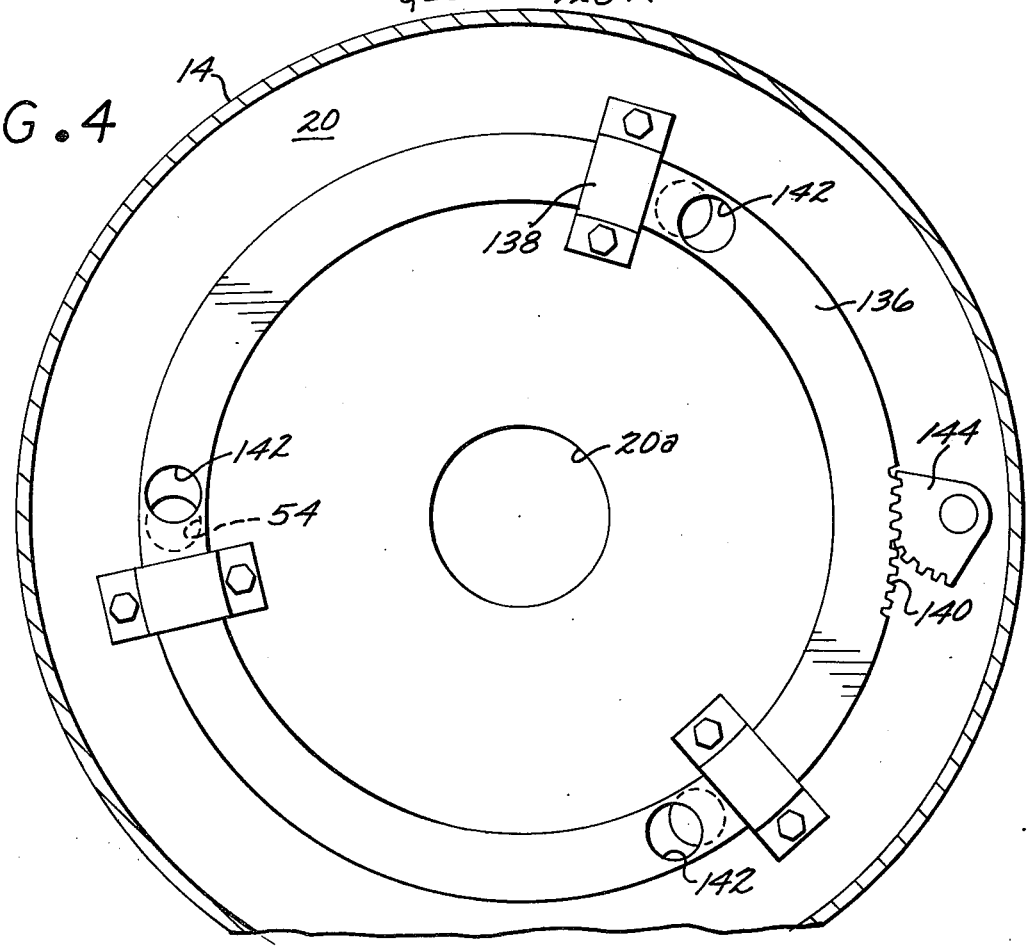
FIG. 4 is a transverse cross-sectional view of the power generating device, taken on the line 4—4 of FIG. 3.

In FIG. 4 it will be seen that a flat ring 136 is slidably and rotatably supported on the upper surface of the partition 20 as viewed in FIG. 3. The ring 136 is maintained in a fixed position on partition 20 by a number of U-shaped guides 138. The ring 136 has a toothed portion 140 formed thereon. A number of third ports 142 are formed in circumferentially spaced positions on the ring 136, and the third ports, as the ring is rotated, capable of being moved into communication with the first ports 54. The toothed portion 140 is engaged by a rotatable tooth member 144 that is secured to the upper end of a rod 146 that, by bearings 148, is rotatably supported in the housing assembly N. The rod 146 projects downwardly below the housing assembly N as viewed in FIG. 3, and by a handle (not shown) may be rotated. Rotation of the rod 146 results in concurrent rotation of the ring 136 to align a desired portion of the third ports 42 with the first ports 54.

Figure 5:
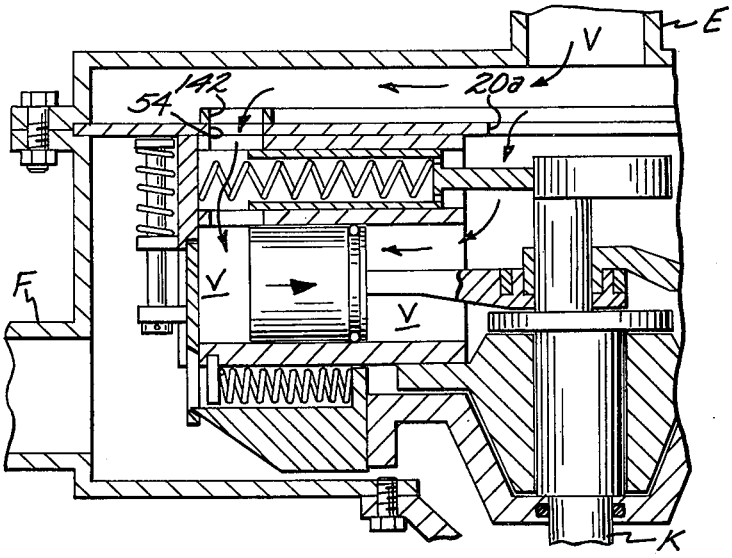
FIG. 5 is a fragmentary cross-sectional view of the power generating device in a position where pressurized vapor flows from the first compartment into the outer portion of one of the first cylinders to equalize the vapor pressure on both the left and right hand end portions of the piston.

The use and operation of the invention is extremely simple. The pressurized vapor is at all times supplied to the first compartment 22. As the power generating device A operates, and the shaft K rotates, each of the first pistons 80, when in the outermost portion of its stroke as shown in FIG. 5, has pressurized vapor on opposite ends thereof. The flow of the vapor to the first pistons 80 is shown in FIG. 5 by arrows. Thus, as each piston 80 moves inwardly from the position as shown in FIG. 5 to that illustrated in FIG. 6, a minimum of work is involved in so moving the piston 80.

Figure 6:
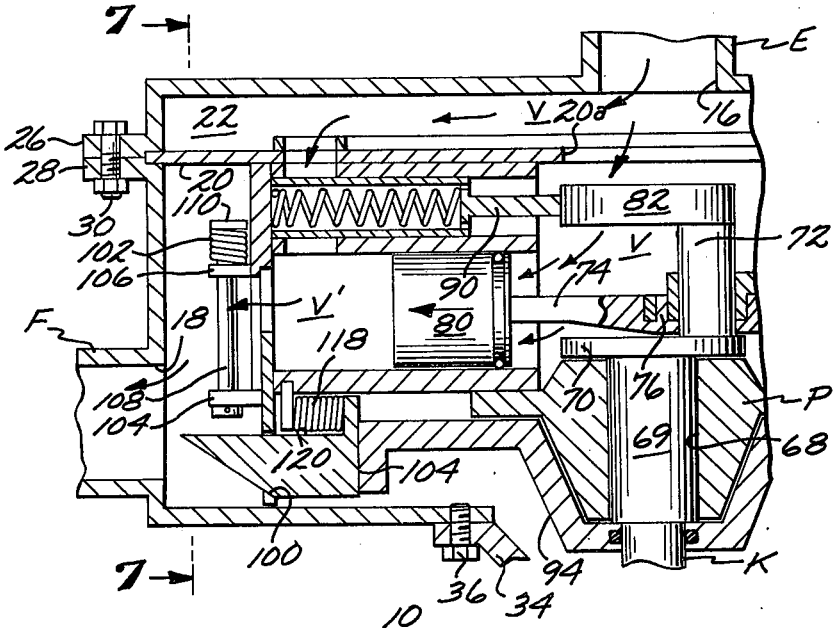
FIG. 6 is the same view as shown in FIG. 5, but with one of the first members so disposed that pressurized vapor flows from the first cylinder to the second compartment and the second conduit, with the pressurized vapor on the right hand end portion of the piston then tending to drive the piston to the left, as viewed in this figure, and cause the power output shaft to rotate.
Figure 7:
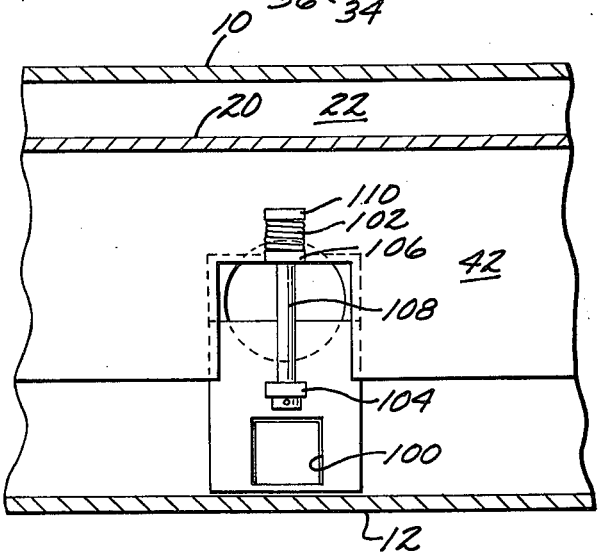
FIG. 7 is a fragmentary cross-sectional view of the device, taken on the line 7—7 of FIG. 6.

When each piston 80 has moved inwardly to the position shown in FIG. 6, the first cam 82 has rotated to a position where the second pistons 88 associated therewith obstruct further flow of vapor into the outer end portion of the cylinder. Concurrently, the first member 96 associated with that particular first cylinder 46, has been moved downwardly by movement of the second member 112 to permit vaport V′ to escape from the cylinder into the second compartment 24 to flow therefrom through the conduit F. The vapor V on the right hand end portion of the first cylinder 80, shown in FIG. 6, now forces the first piston to the left and the connecting rod 74 associated therewith imports rotational movement to the power output shaft K through the pin 72. The above-described operation is performed on each of the first pistons 80 as the shaft K rotates.

The speed of rotation of the shaft K may be controlled by varying the position of the third ports 142 relative to the first ports 54 by rotation of rod 146. By restricting the flow of vapor V into the left hand end portions of a first cylinder 46 when a first piston 80 is in the position shown in FIG. 5, the piston 80 no longer has equal vapor pressure on both ends thereof, and work is then required to move the first piston 80 to the position shown in FIG. 6. Subjecting the first pistons 80 to this increased work load slows down the rate of rotation of power output shaft K.

The power generating device A may be operated on any low boiling liquid such as one of the commercially available Freons used in refrigeration. If desired, an easily liquifiable gas such as carbon dioxide or sulfur dioxide may be employed.

The vapor condensing device D will be of a type suited for the particular liquid that results in the vapor V, and may be of the absorbent or absorbate type. As the vapor V′ discharges from the power generating device A, the vapor expands and in so doing is cooled. Under proper conditions, this cooling combined by the cooling effected by the device D from material causes, such as being located underground, will be sufficient to transform the vapor V′ back to the liquid state.

The use and operation of the invention has been described previously in detail and need not be repeated.

I claim:

1. In combination with a first device for generating heat that transforms a low boiling point liquid into vapor under pressure that is discharged therefrom; a second device that receives said vapor and cools the same to return to the liquid state; a third device which receives said liquid from said second device and returns said liquid to said first device, a power generating device that receives pressurized vapor from said first device and discharges said vapor at reduced pressure to said second device, said power generating device including:

a. a housing assembly that includes a partition that divides the interior of said housing assembly into a first and a second compartment, said first compartment at all times in communication with said first device to receive said vapor under pressure therefrom, and said second compartment in communication with said second device;

b. a cylinder defining assembly disposed in a fixed position in said housing assembly, said cylinder defining assembly including a plurality of circumferentially spaced, radially extending first cylinders, said first cylinders having first open inwardly disposed ends in communication with said first compartment and second outwardly disposed open ends in communication with said second compartment;

c. a power output shaft rotatably supported in said housing assembly and extending outwardly therefrom;

d. a plurality of first pistons slidably and sealingly mounted in said first cylinders, said pistons having first and second ends, said first ends in communication with said first compartment and at all times exposed to said vapor under pressure;

e. a plurality of piston rods having first and second ends, said second ends pivotally connected to said first pistons;

f. eccentric means that rotate concurrently with said power output shaft, with said eccentric means pivotally engaged by said first ends of said piston rods;

g. a plurality of passage means that provide communication between said first compartment and each of said cylinders adjacent said second end of the latter;

h. a plurality of first independently movable means for closing said second ends of said cylinders;

i. a plurality of second independently movable means for closing said passage means;

j. first means actuated by the rotation of said power output shaft for sequentially moving each of said first movable means to an open position when said piston associated therewith has moved to the innermost position and so maintaining said first means as vapor under pressure in said first compartment forces said piston outwardly to the outermost position thereof, with said first means sequentially closing each of said second ends of said cylinders after said piston associated therewith has moved to said outermost position, and each of said pistons as it moves from said innermost to said outermost position by vapor under pressure in said first compartment causing said power output shaft to rotate due to the differential in vapor pressure on said first and second ends of said pistons; and k. second means actuated by the rotation of said power output shaft to sequentially maintain each of said second movable means in an open position as said piston associated therewith moves from an outermost to an innermost position to permit said vapor in communication with said first and second ends of said piston to be at substantially equal pressure to minimize the energy required to move said piston from said outermost to said innermost position and said second means sequentially closing each of said passage means as said piston associated therewith starts to move from said outermost to said innermost position.

2. A power generating device as defined in claim 1 in which said cylinder defining assembly includes first and second end walls that have first and second concentric shells extending therebetween, said first and second shells having a plurality of first and second circumferentially spaced openings therein, and said plurality of cylinders disposed between said first and second end walls and extending radially between said first and second openings therein, said first end wall having an opening therein that at all times maintains communication between said first compartment and said first openings in said first shell, and said plurality of first independently movable means being a plurality of first springs and first spring loaded members slidably supported on said second shell that at all times tends to remain in positions where they close said second openings.

3. A power generating device as defined in claim 2 in which said members have third openings therein out of alignment with said second openings, and said second means includes a plurality of second springs and second spring loaded members slidably supported from said second sidewall, said second spring loaded members each including a first inner end and a second outer tapered end that is in engagement with one of said third openings; and a cam on said power output shaft that has first ends of said second spring loaded members in slidable pressure contact therewith, and said cam as it rotates with said power output shaft sequentially moving each of said second members outwardly for said second end thereof to move outwardly through said third opening associated therewith to move said member in which said opening is defined to said open position.

4. A power generating device as defined in claim 1 in which said eccentric means includes:

l. a head secured to said shaft adjacent said first ends of said first cylinders; and m. an off-centered pin that extends from said head and is pivotally engaged by said second ends of said piston rods.

5. A power generating device as defined in claim 4 in which said plurality of second independently movable means includes:

n. a plurality of second cylinders parallel to said first cylinder, each of said second cylinders adjacent said second end thereof having a first port therein that is in communication with said first compartment and the interior of said second cylinder and a second port in communication with the interior of said second cylinder and a second port in communication with the interior of said second cylinder and said first cylinder associated therewith;

o. a cam mounted on said shaft; and p. a plurality of spring loaded second pistons slidably and sealingly supported in said second cylinders, said second pistons in sliding pressure contact with said cam mounted on said shaft, and said cam mounted on said power output shaft as said cam rotates sequentially moving said second pistons to concurrently establish communication between said first and second ports and break communication between said first and second ports associated therewith.

6. A power generating device as defined in claim 5 which in addition includes:

q. third manually operable means for controlling the speed of rotation of said power output shaft by controlling the rate at which said vapor can flow from said first compartment through said first and second ports into said first cylinders as said first pistons move from outermost to innermost positions.

7. In combination with a first device for generating heat that transforms a low boiling point liquid into vapor under pressure that is discharged therefrom; a second device that receives said vapor and cools the same to return to the liquid state; a third device which receives said liquid from said second device and returns said liquid to said first device, a power generating device that receives pressurized vapor from said first device and discharges said vapor at reduced pressure to said second device, said power generating device including:

a. a housing assembly that includes first and second spaced end walls connected by a continuous side wall, said firt end wall having a first conduit extending therefrom to receive said vapor from said first device, said side wall having a second conduit extending therefrom to said second device to deliver said vapor to the latter, and a transverse partition in said housing that subdivides the interior into first and second compartments that are in communication with said first and second conduits;

b. a cylinder defining assembly secured to said partition and disposed in said housing, said cylinder defining assembly including a first inner cylindrical shell having a plurality of circumferentially spaced first openings formed therein, a second outer cylindrical shell having a plurality of circumferentially spaced second openings therein that are radially aligned with said first openings, said first and second shells having first and second circumferential edges, a plurality of first tubular cylinders that extend radially between said first and second openings in said first and second shells, a plurality of second tubular cylinders that extend inwardly from said second shell and are parallel thereto, and first and second circular plates that extend between said first circumferential edges of said first and second shells and said second circumferential edges thereof, said first plate adjacently disposed to said partition and secured thereto, a plurality of circumferentially spaced sets of first ports that extend through said partition and second cylinders to establish communication between said first compartment and the interior of said second cylinders, and a plurality of circumferentially spaced second ports that establish communication between the interiors of said second and first cylinders and are axially aligned with said first ports;

c. first bearing means in said housing coaxially aligned with said first shell, said first bearing means being supported from said cylinder defining assembly;

d. a power output shaft journaled in said bearing means and extending outwardly through an opening in said second end wall;

e. a head secured to said shaft and disposed within said first shell;

f. a pin eccentrically mounted on said head, said pin extending towards said partition;

g. a plurality of connecting rods having first and second end portions, said first end portions pivotally connected to said pin;

h. a plurality of first pistons slidably mounted in said first cylinders, said second end portions of said piston rods pivotally connected to said first pistons;

i. a first cam supported in a fixed position relative to said head;

j. a plurality of second pistons slidably mounted in said second cylinders;

k. a plurality of first springs that at all times maintain said second pistons in contact with said first cam;

l. a second cam secured to said shaft and disposed within said housing;

m. a plurality of circumferentially spaced first members slidably supported on said second shell and when in first positions closing said second openings in said second shell, said first members including projecting portions in which openings are defined;

n. a plurality of second springs that at all times tend to maintain said first members in said first positions;

o. a plurality of second members that are circumferentially spaced and slidably supported for radial movement from said second plate, each of said second member including a first end that is in slidable abutting contact with said second cam, and a second angularly disposed end that engages one of said openings in one of said projecting portions; and p. a plurality of third springs that maintain said second members in contact with said second cam, with said power output shaft being driven by said vapor under pressure flowing from said first compartment through an opening in said partition to the interior of said first shell and inwardly disposed end portions of said first cylinders, said first cam cooperating with each of said second pistons and first springs to sequentially open one of said first sets of ports and second port associated therewith to allow said vapor from said first compartment to flow into one of said first cylinders until said first piston therein has traversed to substantially its innermost position whereupon said first cam has rotated to a position where said second piston operatively associated with that particular first cylinder is moved to a position to obstruct communication between said first compartment and said particular first cylinder, with said second cam as it rotates then moving one of said first members outwardly for said first member to move said second member associated with that particular first cylinder towards said second end wall to align said opening in said second member with said particular first cylinder to allow said vapor in said particular first cylinder to escape therefrom to said second compartment and second conduit, and the differential in vapor pressure between first and second end portions of said piston in that particular cylinder forcing said piston outwardly to rotate said power output shaft.

* * * * *